US008045870B2

(12) United States Patent
Nishida et al.

(10) Patent No.: US 8,045,870 B2
(45) Date of Patent: Oct. 25, 2011

(54) IMAGE FORMING APPARATUS HAVING BRUSH AND CLEANING BLADE TO REMOVE TONER REMAINING ON IMAGE CARRIER

(75) Inventors: Satoshi Nishida, Saitama (JP); Hiroshi Morimoto, Akiruno (JP); Kazuteru Ishizuka, Itabashi-ku (JP)

(73) Assignee: Konica Minolta Business Technologies, Inc. (JP)

( * ) Notice: Subject to any disclaimer, the term of this patent is extended or adjusted under 35 U.S.C. 154(b) by 531 days.

(21) Appl. No.: 12/269,184

(22) Filed: Nov. 12, 2008

(65) Prior Publication Data

US 2009/0129798 A1 May 21, 2009

(30) Foreign Application Priority Data

Nov. 16, 2007 (JP) ..... 2007-297786

(51) Int. Cl.

| | |
|---|---|
| ***G03G 15/00*** | (2006.01) |
| ***G03G 15/16*** | (2006.01) |
| ***G03G 15/20*** | (2006.01) |
| ***G03G 21/00*** | (2006.01) |

(52) U.S. Cl. ..... 399/48; 399/66; 399/71; 399/123; 399/343; 399/349

(58) Field of Classification Search ..... 399/48, 399/66, 71, 123, 343, 349

See application file for complete search history.

(56) References Cited

U.S. PATENT DOCUMENTS

| | | | | |
|---|---|---|---|---|
| 7,668,480 | B2 * | 2/2010 | Nakayama et al. | 399/101 |
| 7,903,995 | B2 * | 3/2011 | Nakamatsu et al. | 399/101 |
| 2004/0218941 | A1 * | 11/2004 | Katsumi | 399/66 |
| 2005/0084305 | A1 * | 4/2005 | Nishida et al. | 399/346 |
| 2007/0059067 | A1 * | 3/2007 | Tanaka et al. | 399/346 |
| 2007/0177911 | A1 * | 8/2007 | Nishiwaki et al. | 399/299 |
| 2008/0193178 | A1 * | 8/2008 | Sugimoto et al. | 399/354 |
| 2009/0028591 | A1 * | 1/2009 | Kubo | 399/50 |

FOREIGN PATENT DOCUMENTS

JP 10-254323 9/1998

* cited by examiner

*Primary Examiner* — David Gray
*Assistant Examiner* — Francis Gray
(74) *Attorney, Agent, or Firm* — Cantor Colburn LLP

(57) ABSTRACT

An image forming apparatus includes: an image carrier; a charging unit which charges a surface of the image carrier; a brush which removes toner remaining on the image carrier by rubbing the surface of the image carrier; a cleaning blade provided downstream of the brush in a rotational direction of the image carrier, which removes the toner remaining on the image carrier; a surface potential measuring sensor which measures a surface potential of the image carrier between the brush and the cleaning blade; and a controller which causes the surface potential measuring sensor to conduct a measuring operation and adjusts the surface potential of the image carrier between the brush and the cleaning blade on the basis of a measurement result.

7 Claims, 9 Drawing Sheets

IMAGE FORMING APPARATUS HAVING BRUSH AND CLEANING BLADE TO REMOVE TONER REMAINING ON IMAGE CARRIER

This application is based on Japanese Patent Application No. 2007-297786 filed on Nov. 16, 2007, which is incorporated hereinto by reference.

BACKGROUND OF THE INVENTION

The present invention relates to an image forming apparatus of an electrophotographic method wherein residual toner on an image carrier is removed by a brush and a cleaning blade.

In recent years, image forming apparatuses of an electrophotographic method are introduced in many offices. In the image forming apparatus of an electrophotographic method, a latent image formed on a photoreceptor (image carrier) is visualized, thus, a toner image on a photoreceptor is transferred onto a sheet or onto an intermediate transfer member. On the photoreceptor from which images have been transferred, there remains toner that has not been transferred. Therefore, the residual toner is removed by a brush or a cleaning blade.

However, there are sometimes occasions where toner on the photoreceptor cannot be removed even by a brush and a cleaning blade, and if the toner and its additive which have failed to be removed continue sticking on the photoreceptor, a stuck matter grows greater while image forming is continued, resulting in a main cause for occurrence of image defect.

A technology described in Unexamined Japanese Patent Application Publication No. 10-254323 is one to change a difference between a linear velocity on a surface of a photoreceptor and a linear velocity on an outer circumference of a brush roller, at least once during a period of time from the start of rotation of the photoreceptor to its stop. This technology can suppress an increase of sticking toner, and prevent image defect.

Incidentally, in the image forming apparatus wherein residual toner on a photoreceptor is removed by using both a brush and a cleaning blade, when images having a high image area rate are printed continuously, a large amount of toners stick to the brush, and the brush turns out to be under the condition that it contains toner. When the brush turns out to be under the condition to contain toner, toner and its additive move from the brush to the photoreceptor, depending on electric potential of the photoreceptor that faces the brush, and the toner and its additive stick to the photoreceptor undesirably. After the toner and its additive have stuck to the photoreceptor once, toner and its additive further stick beginning from the stuck toner serving as the starting point, and stuck matter grows greater, when printing for a long time (as shown in FIG. 4, stuck matter $\alpha$ such as toner on photoreceptor 410 has a shape of a raindrop, and a large stuck matter sometimes grows up to 5 mm or more although a size of small stuck matter $\alpha$ is about 10 μm that cannot be confirmed visually). As a result, stuck matters cause an occurrence of image defect that a part of a halftone image and a part of a solid image are lost.

However, in the technology described in Unexamined Japanese Patent Application Publication No. 10-254323, it is not possible to suppress sufficiently the stuck matters generated through the circumstances.

SUMMARY OF THE INVENTION

With the aforesaid background, an object of the invention is to provide an image forming apparatus that prevents adhesion of toner or the like on an image carrier, and forms an excellent image.

For attain the aforesaid objective, the image forming apparatus relating to the invention is characterized to have therein an image carrier, a charging unit that charges a surface of the image carrier, a brush that removes toner remaining on the image carrier by rubbing the surface of the image carrier, a cleaning blade that removes toner remaining on the image carrier on the downstream side in the rotating direction of the image carrier for the aforesaid brush, a surface potential measuring sensor that measures surface potential of the image carrier between the brush and the cleaning blade and a controller that carries out measuring operations by a surface potential measuring sensor and adjusts the surface potential of the image carrier between the brush and the cleaning blade, based on results of the measurement.

Further, the image forming apparatus relating to the invention is characterized to have therein an image carrier, a charging unit that charges a surface of the image carrier, a transfer unit that transfers a toner image formed on the image carrier onto an object to which an image is transferred, a brush that removes toner remaining on the image carrier by rubbing the surface of the image carrier, a cleaning blade that removes toner remaining on the image carrier on the downstream side in the rotating direction of the image carrier for the aforesaid brush, a charging potential measuring sensor that measures charging potential of the image carrier that is charged by the charging unit, a memory unit that stores a data table in which a relation among the charging potential of the image carrier charged by the charging unit, a transfer current value in the transfer unit and a stuck matter sticking to the image carrier is stipulated, and a controller that compares a result of measurement by the charging potential measuring sensor with the transfer current value in the transfer unit, in the data table, and corrects the transfer current value in the transfer unit or an image density, according to a result of the comparison.

Figure 3:
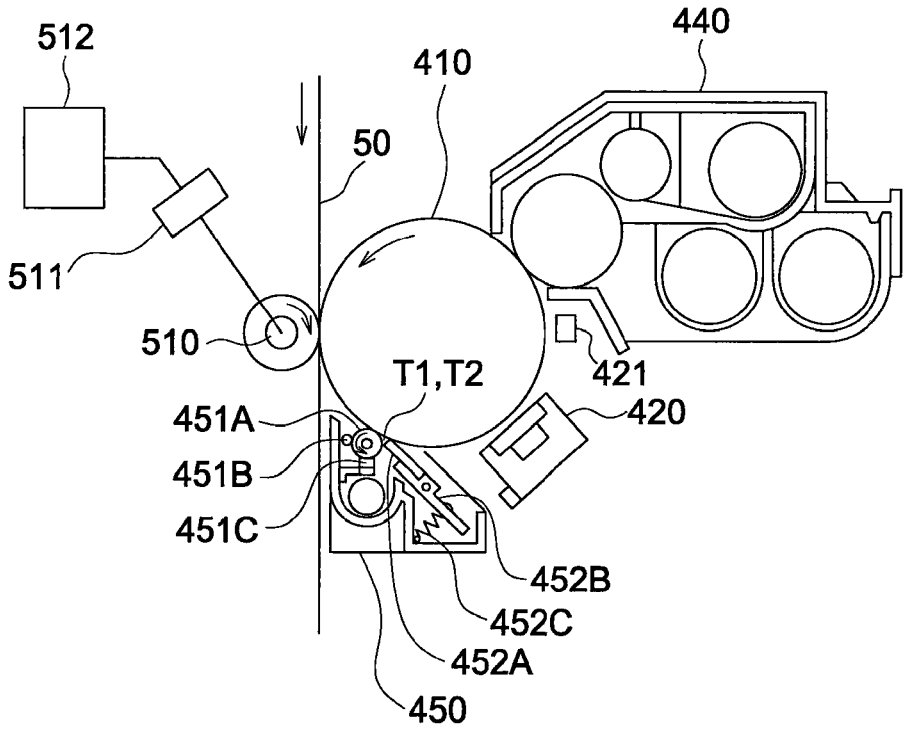
Figure 3:
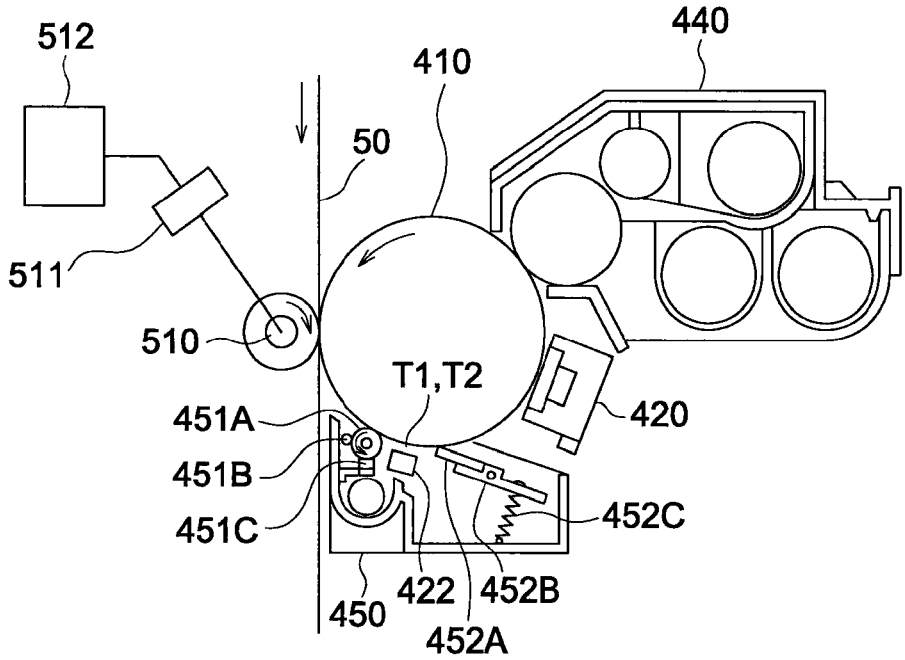

Each of FIG. 3(*a*) and FIG. 3(*b*) is an enlarged diagram of the surroundings of a photoreceptor.

Figure 4:
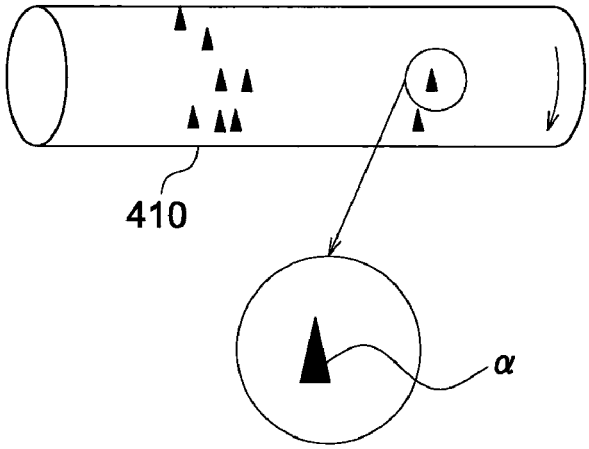

FIG. 4 is an illustration showing stuck matters such as toner on the photoreceptor.

Figure 5:
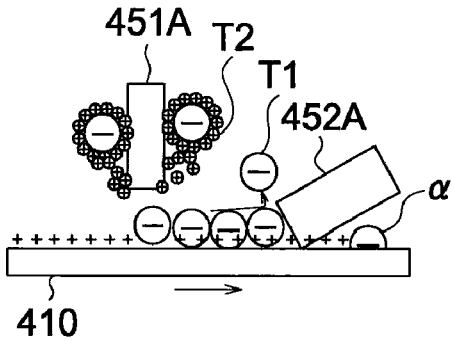
Figure 5:
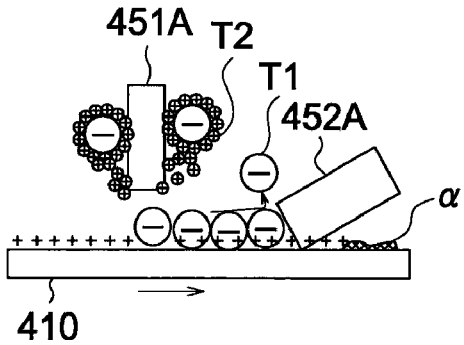

Each of FIG. 5(*a*) and FIG. 5(*b*) is an enlarged diagram of the surroundings of a brush and a cleaning blade.

Figure 6:
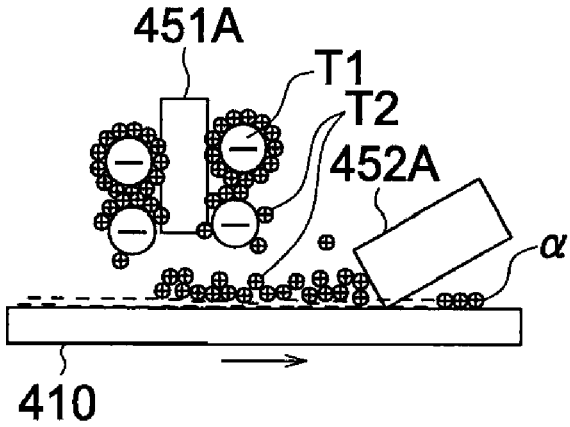
Figure 6:
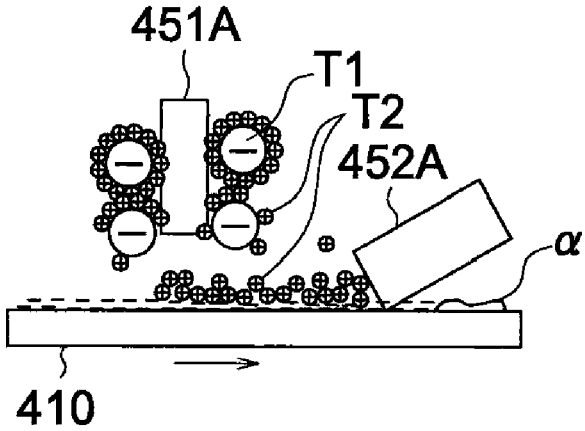

Each of FIG. 6(*a*) and FIG. 6(*b*) is an enlarged diagram of the surroundings of a brush and a cleaning blade.

Figure 7:
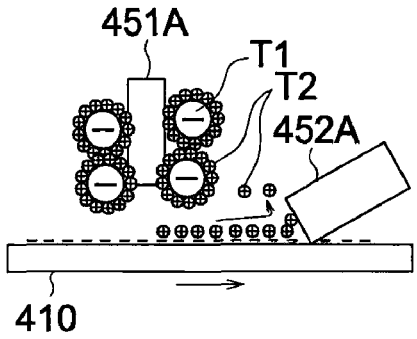
Figure 7:
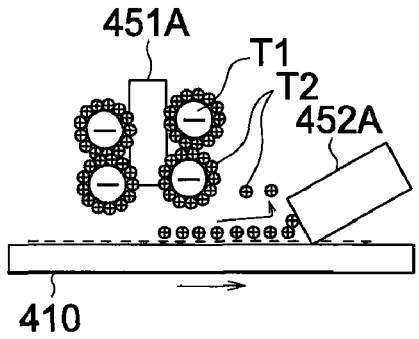

Each of FIG. 7(*a*) and FIG. 7(*b*) is an enlarged diagram of the surroundings of a brush and a cleaning blade.

Figure 8:
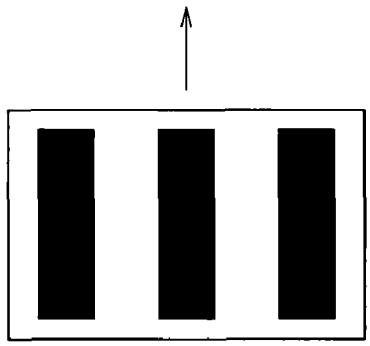

FIG. 8 is a diagram showing a pattern of an image used in experiments.

Figure 9:
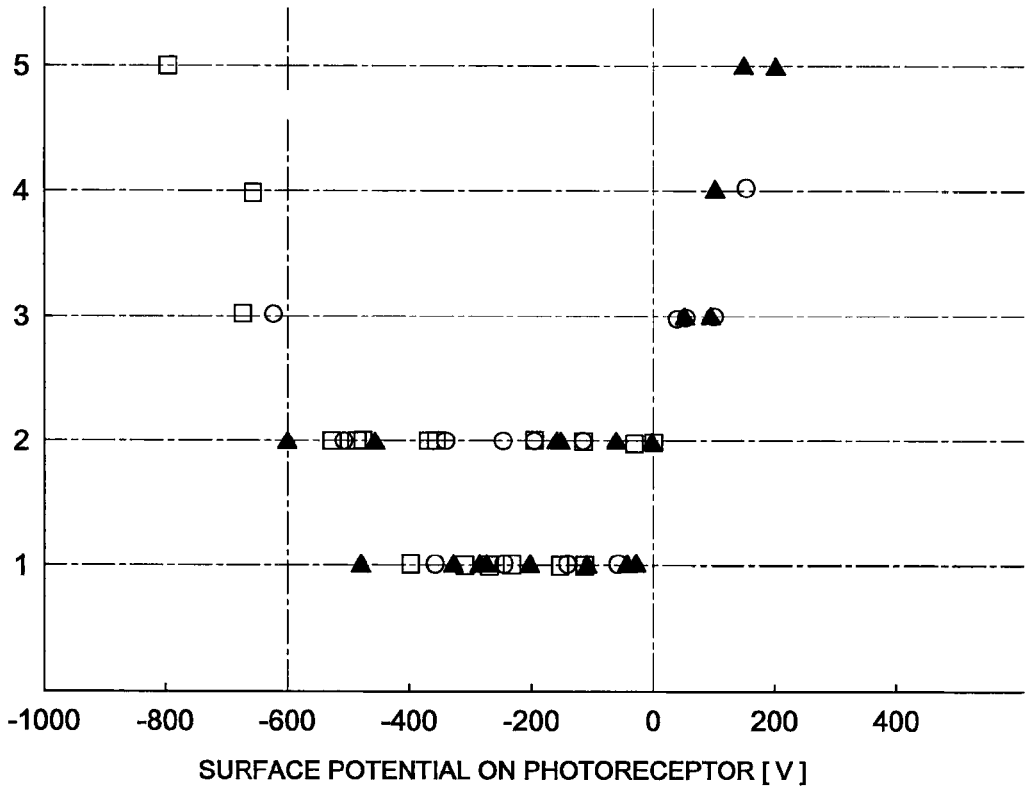

FIG. 9 is a graph showing relationship between surface potential of a photoreceptor and results of evaluation.

Figure 10:
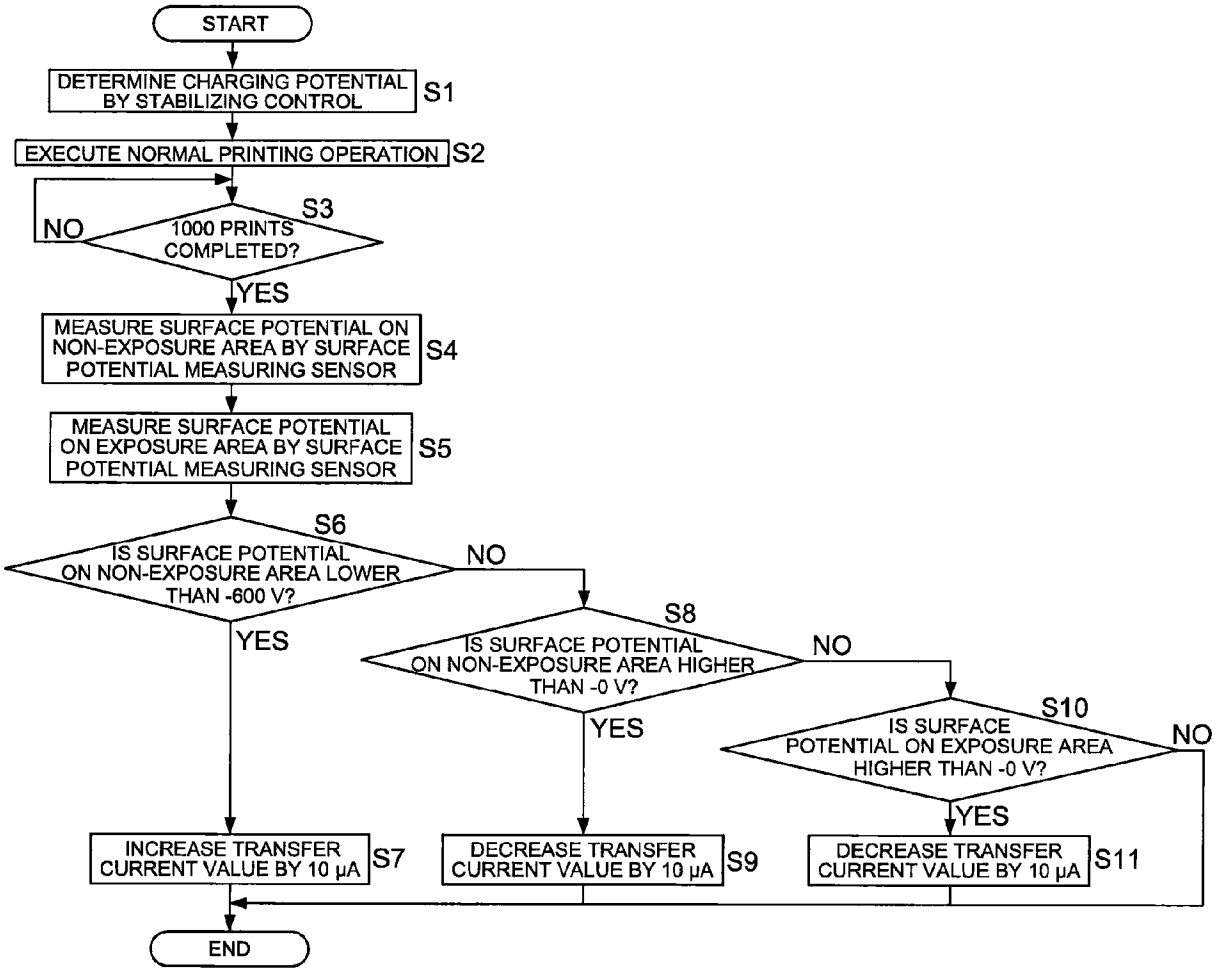

FIG. 10 is a flow chart relating to operations to control surface potential of a photoreceptor based on results of measurements of surface potential between a brush and a cleaning blade.

Figure 11:
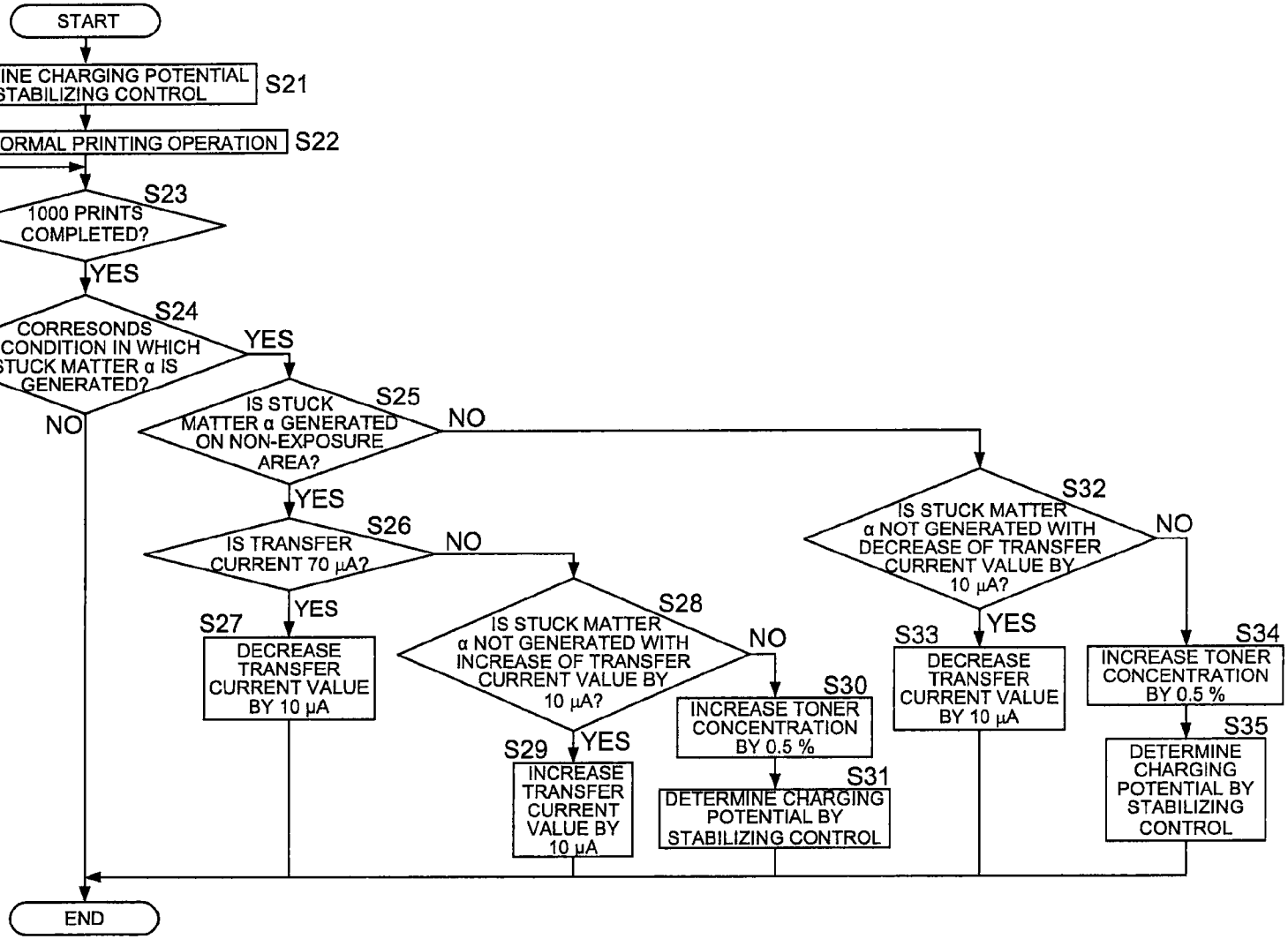

FIG. 11 is a flow chart relating to operations to control surface potential of a photoreceptor.

DETAILED DESCRIPTION OF THE PREFERRED EMBODIMENT

Figure 1:
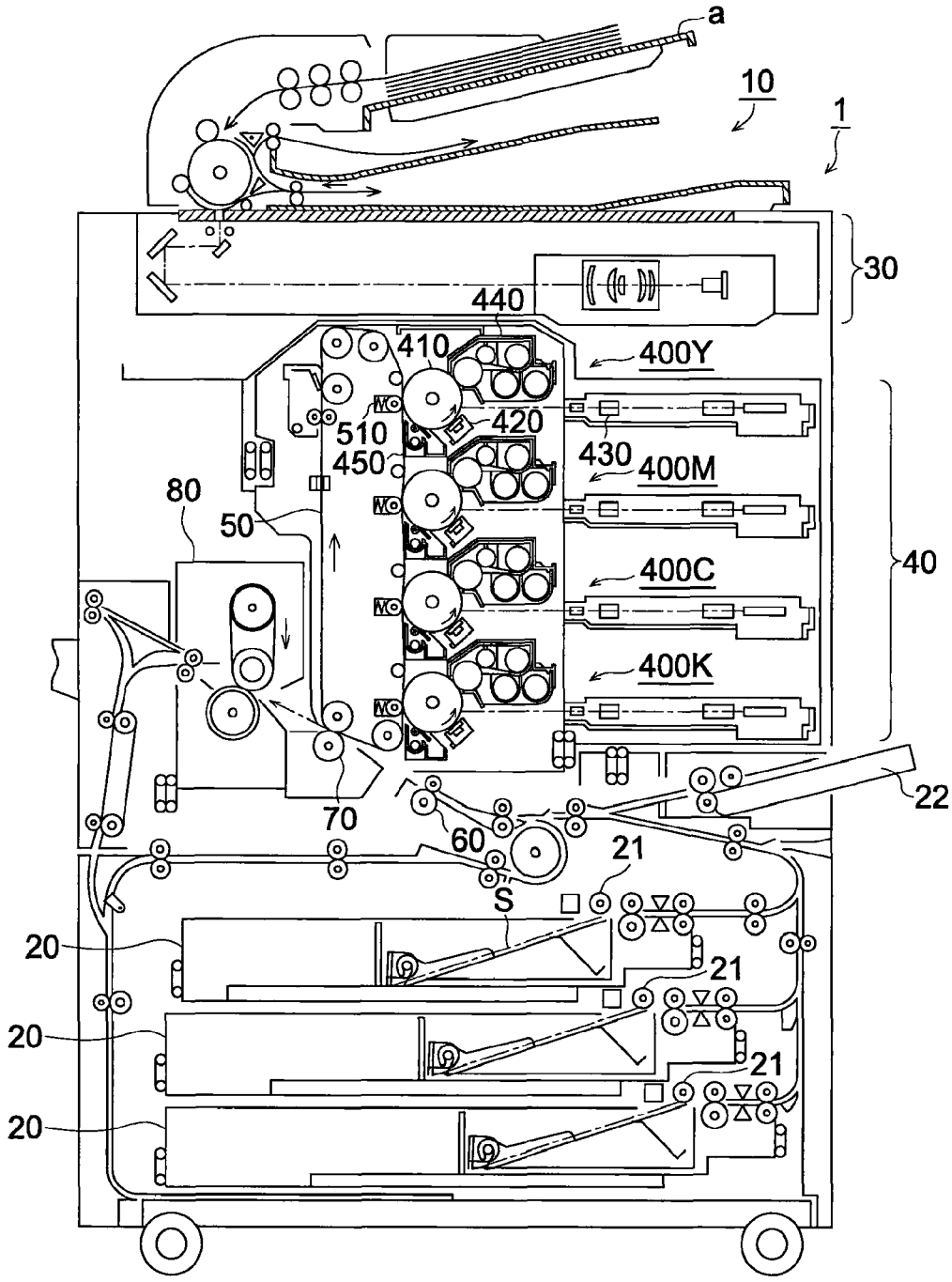
FIG. 1 is a central sectional view showing an internal structure of an image forming apparatus.

FIG. 1 is a central sectional view showing an internal structure of image forming apparatus 1.

The image forming apparatus 1 is a color image forming apparatus of a tandem type having therein intermediate transfer belt 50.

The image forming apparatus 1 has, thereunder, plural sheet storing units 20. Above the sheet storing units 20, there are arranged image forming unit 40 and intermediate transfer belt 50, and above the apparatus main body, there is arranged image reading unit 30.

A document set on document feeding table of two-sided document automatic feeder 10 is conveyed by various types of rollers toward image reading unit 30.

The sheet storing unit 20 can be drawn out toward the front side of the apparatus (to this side on a page in FIG. 1). In plural sheet storing units 20, there are stored sheets S such as white sheets which are classified by a size. Sheet S stored in the sheet storing unit 20 is fed by sheet feed roller 21 one sheet by one sheet. On manual feed unit 22, there is set a special sheet such as an OHP sheet.

The image forming unit 40 has four sets of image forming engines 400Y, 400M, 400C and 400K which are for forming respectively toner images for Y (Yellow) color, M (Magenta) color, C (Cyan) color and K (Black) color. Image forming engines 400Y, 400M, 400C and 400K are arranged in a form of a straight line in this order from the top to the bottom, and each of them is the same as others in terms of structure.

An explanation of the structure will be given as follows, with an example of the image forming engine 400Y for a yellow color. The image forming engine 400Y has therein photoreceptor 410 that rotates counterclockwise, charging unit 420, exposure unit 430, developing unit 440 and cleaning unit 450. The cleaning unit 450 is arranged including an area that faces a lowermost portion of the photoreceptor 410.

Intermediate transfer belt 50 positioned at a central part of the apparatus main body is in an endless form, and has a prescribed volume resistivity. Primary transfer roller (transfer unit) 510 is located at a position at which the primary transfer roller 510 faces photoreceptor 410 across intermediated transfer belt 50.

Next, operations to form a color image in image forming apparatus 1 will be explained.

The photoreceptor 410 is driven to rotate by a drive motor (not shown), and is charged through an electrical discharge of charging unit 420 to be in negative polarity (for example, −800V). Next, writing with light depending on image information is conducted by exposure unit 430 on photoreceptor 410, which forms an electrostatic latent image. When the electrostatic latent image thus formed passes through developing unit 440, toner charged to be in negative polarity sticks to a portion of the latent image through impression of negative polarity development bias, in the developing unit, thus, a toner image is formed on the photoreceptor 410. The toner image thus formed is transferred onto intermediate transfer belt 50 that is in pressure contact with photoreceptor 410. Toner remaining on the photoreceptor 410 after transfer is removed by cleaning unit 450.

When toner images which are formed respectively by image forming engines 400Y, 400M, 400C and 400K are transferred onto intermediate transfer belt 50 with an overlap, a color image is formed on the intermediate transfer belt 50. Sheet S is fed out by sheet storing unit 20 one by one to be conveyed to the position of registration roller 60 that functions as a registration conveyance section. Sheet S hits the registration roller 60 to be stopped once, and a skew of the sheet S is corrected. The sheet S is fed from the registration roller 60 at the timing with which a toner image on the intermediate transfer belt 50 agrees with an image position.

Sheet S fed by registration roller 60 is guided by a guide plate, and is sent to a position of a transfer nip formed by intermediate transfer belt 50 and transfer unit 70. The transfer unit 70 constituted with rollers presses the sheet S toward the intermediate transfer belt 50 side. With impression of bias voltage (for example, +500V) that is opposite in terms of polarity to toner on the transfer unit 70, a toner image on the intermediate transfer belt 50 is transferred onto the sheet S through static electricity force. The sheet S is neutralized by a separation device (not shown) composed of neutralizing needles, and is separated from the intermediate transfer belt 50 to be sent to fixing unit 80 composed of paired rollers including a heat roller and a pressure roller. As a result, the toner image is fixed on the sheet S, thus, the sheet S on which an image has been formed is ejected out of the apparatus.

Incidentally, though the image forming apparatus 1 in the present embodiment is one for forming a color image through an electrophotographic method, an image forming apparatus relating to the invention is not limited to the present embodiment, and it may also be an image forming apparatus forming a monochrome image.

Figure 2:
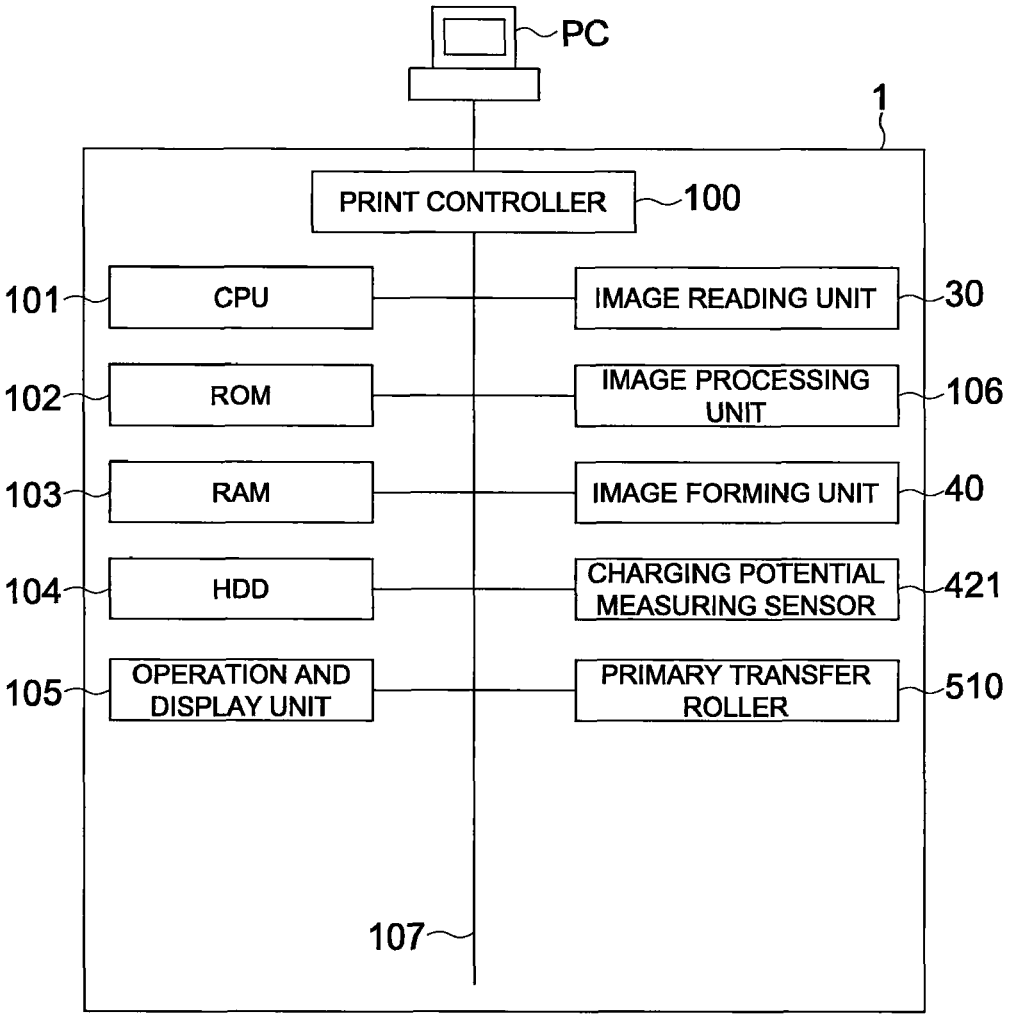
FIG. 2 is a block diagram of a controller system for the image forming apparatus.

FIG. 2 is a block diagram of a controller system for image forming apparatus 1, and in this case, typical ones only are shown.

CPU (Central Processing Unit) 101 is connected to ROM (Read Only Memory) 102 and to RAM (Random Access Memory) 103, through system bus 107. This CPU 101 reads out various programs stored in ROM 102, and develops them in RAM 103 to control actions of respective sections. In addition, CPU 101 conducts various processes in accordance with programs developed in RAM 103, and stores processing results in RAM 103, and causes operation and display unit 105 to display them. Then, the CPU 101 causes a prescribed target for preservation to preserve the processing results stored in RAM 103. Meanwhile, in the present embodiment, the CPU 101 constitutes a controller together with ROM 102 and RAM 103.

ROM 102 stores programs and data in advance, and it is constituted typically with a semiconductor memory.

RAM 103 forms a work area that stores temporarily data processed by various programs conducted by CPU 101.

HDD (Hard Disk Drive) 104 has functions to store image data of document image obtained by reading with image reading unit 30, and to store outputted image data. It has a metal disk on which magnetic substances are coated or deposited, and when this disk is rotated at high speed by a motor, and a magnetic head is brought close to the disk, data are read and written.

Operation and display unit 105 is one that makes various setting to be possible. For example, the operation and display unit 105 is in a form of a touch panel, and when a user inputs through the operation and display unit 105, conditions relating to color printing and monochrome printing are established. Further, information of network setting and various types of information are indicated on the operation and display unit 105.

Image reading unit 30 reads document images optically and converts them into electric signals. When reading color documents, it generates image data having luminance information of 10 bits for each of R, G and B per one pixel.

Image processing unit 106 conducts image processing for image data generated by image reading unit 30 and for image data transmitted from PC connected to image forming apparatus 1. When conducting color printing on the image forming apparatus 1, image data for R (Red), G (green) and B (Blue) generated by image reading unit 30 are inputted in color conversion LUT in image processing unit 106, so that color conversion for data for R, G and B may be conducted into image data for Y (Yellow), M (Magenta), C (Cyan) and Bk (Black). Then, for the image data thus converted in terms of color conversion, tone reproduction characteristics are corrected, screen processing such as halftone dots are conducted, referring to density correction lookup table LUT, and edge processing for emphasizing fine lines is conducted.

Image forming unit 40 receives image data on which image processing has been conducted by image processing unit 106, and it forms an image on a sheet.

Charging potential measuring sensor 421 is one to measure charging potential of photoreceptor 410 with charging unit 420, and based on results of the measurements, output values of the charging unit 420 and transfer current values of primary transfer roller 510 are controlled by CPU 101.

Each of FIG. 3(*a*) and FIG. 3(*b*) is an enlarged diagram of the surroundings of a photoreceptor 410.

High-voltage power supply section 512 is connected to primary transfer roller 510 that is controlled in terms of constant current by the high-voltage power supply section 512. A transfer current value in the primary transfer roller 510 is detected by transfer current detection device 511.

As shown in FIG. 3(*a*), brush 451A is provided on the upstream side of photoreceptor 410 in its rotation direction, in cleaning unit 450, and cleaning blade 452A is provided on the downstream side of photoreceptor 410 in its rotation direction.

Toner remaining on photoreceptor 410 after transfer is removed by brush 451A and by cleaning blade 452A. Toner T1 remaining on photoreceptor 410 is scraped off or disturbed by the brush, thus, adhesive power between toner T1 and photoreceptor 410 is lowered, and then, toner T1 is removed by cleaning blade 452A.

Flicking member 451B is in contact with brush 451A, and toner T1 sticking to brush 451A is removed by flicking member 451B. Further, solid lubricant 451C is in contact with brush 451A, and lubricant is coated on photoreceptor 410 through brush 451A.

Cleaning blade 452A is held by blade holder 452B, and cleaning blade 452A is caused by force of spring 452C that urges the blade holder 452B to be pressed against photoreceptor 410.

Cleaning blade 452A is an elastic body which includes specifically urethane rubber, silicone rubber, fluorinated rubber, chloroprene rubber and butadiene rubber. In particular, urethane rubber is preferable on the point that its abrasive resistance is better than those of other rubbers.

Stuck matters such as toner T1 generated on photoreceptor 410 will be explained again as follows, though they were described earlier. When images having high image area rate are printed continuously, toner T1 in a large quantity sticks to brush 451A undesirably, and the brush 451A turns out to be under the condition of containing toner T1. When the brush 451A turns out to be under the condition of containing toner T1, toner T1 and external additive T2 of toner T1 shift to photoreceptor 410 from brush 451A and stick to photoreceptor 410, depending on voltage on photoreceptor 410 facing the brush 451A. After the toner T1 and external additive T2 of toner T1 have stuck to photoreceptor 410 once, when conducting printing for a long time, toner T1 and external additive T2 further stick with the stuck toner T1 serving as a starting point (a core), and stuck matters grow greater. As a result, there is caused image defect that a part of a halftone image and a part of a solid image are lost by stuck matters.

As shown in FIG. 4, stuck matter α such as toner T1 on photoreceptor 410 has a shape of a raindrop. Stuck matter α has a various sizes, and a size of small stuck matter α is about 10 μm that cannot be confirmed visually, while, a large stuck matter sometimes grows up to 5 mm or more.

After an examination about stuck matter α, it was found out that surface potential of photoreceptor 410 between brush 451A and cleaning blade 452A has an influence on occurrence of stuck matter α. Detailed explanation on this point will be given as follows, referring to FIG. 5-FIG. 7.

Each of FIG. 5(*a*) and FIG. 7(*b*) is an enlarged diagram of the surroundings of cleaning blade 452A.

Brush 451A is grounded electrically, and toner T1 is charged negatively, while, external additive T2 is charged positively.

When a transfer current value on primary transfer roller 510 is large, surface potential of photoreceptor 410 between brush 451A and cleaning blade 452A turns out to be positive after the primary transfer, as shown in FIG. 5(*a*). Under this state, toner T1 having moved from the brush 451A sticks firmly to photoreceptor 410 electrically, whereby, toner T1 brushes past the cleaning blade 452A, thus, stuck matter α is formed as shown in FIG. 5(*a*) or FIG. 5(*b*), as a result of printing for a long time.

Further, when potential at which photoreceptor 410 is charged by charging unit 420 (hereinafter referred to as "charging potential") is high, or when a transfer current value on primary transfer roller 510 is small, surface potential of photoreceptor 410 between brush 451A and cleaning blade 452A turns out to be negative after the primary transfer, as shown in FIG. 6(*b*). If an absolute value of surface potential that is negative is large, external additive T2 of toner T1 sticking to brush 451A moves to photoreceptor 410, whereby, external additive T2 brushes past the cleaning blade 452A, thus, stuck matter α is formed as shown in FIG. 6(*a*) or FIG. 6(*b*), as a result of printing for a long time.

When surface potential of photoreceptor 410 between brush 451A and cleaning blade 452A shows an appropriate value as shown in FIG. 7(*a*)-FIG. 7(*b*), toner T1 does not move to photoreceptor 410, and even if external additive T2 sticks to photoreceptor 410, it is removed by cleaning blade 452A, thus, stuck matter α shown in FIGS. 5(*a*)-5(*b*) and FIGS. 6(*a*)-6(*b*) is not formed in spite of printing for a long time.

With a background mentioned above, an appropriate range of surface potential on photoreceptor 410 between brush 451A and cleaning blade 452A which does not generate stuck matter α was studied through experiments.

Conditions used in the aforesaid experiments are as follows.

Process speed of 300 mm/s was used, and an organic photoreceptor (overcoat layer: polycarbonate resins having therein dispersed silica) having a diameter of 60 mm was used as photoreceptor 410.

As brush 451A, a roller having a diameter of 12 mm wherein bristles (a length of a bristle is 3 mm) are planted on a core metal whose diameter is 6 mm was used. An amount of cutting into the photoreceptor for the brush was made to be 1 mm, an amount of cutting into the flicking member for the brush was made to be 0.7 mm, and as a bristle of brush 451A, there were used three types of fibers including conductive and acrylic fiber SA-7 made by TORAY INDUSTRIES, INC., GBN fiber made by KB SEIREN, LTD. and UUN fiber made by UNITIKA LTD.

As solid lubricant lubricant 451C, Zn-St was used, and a solid lubricant having dimensions of 8 mm (height)×5 mm (width)×320 mm (length) was pressed against the brush by a spring from a rear side of the brush.

Surface potential on photoreceptor 410 between brush 451A and cleaning blade 452A was measured by Model 344 of Trek Surface Potential Meter System, and measurement was conducted in ordinary printing operations.

For the purpose of adhering toner on brush 451A before experiments, transfer output of primary transfer roller 510 was made to be off, and solid images were formed on several sheets.

When acquiring surface potential on photoreceptor 410 between brush 451A and cleaning blade 452A, data obtained through measurement at the position on the downstream side of cleaning blade 452A were used, as data of surface potential on photoreceptor 410 having thereon no toner. Further, as data of surface potential on photoreceptor 410 having thereon toner, data obtained through measurement at the position on the downstream side of the cleaning blade under the state wherein cleaning blade 452A is removed were used, as data of surface potential on photoreceptor 410 having thereon toner. Then, correlation for both occasions was preserved, and potential measurement in the experiments was made to be only for surface potential on photoreceptor 410 after passage of a cleaning blade, and surface potential before the passage was obtained through an estimation from the aforesaid correlation.

Incidentally, an image pattern used in the experiment is one formed from a belt-shaped solid image as shown in FIG. 8.

Results of the measurements for surface potential on photoreceptor 410 between brush 451A and cleaning blade 452A are shown in Table 1-Table 3. Transfer current values in primary transfer roller 510 were made to be four kinds including 33 μA, 50 μA, 67 μA and 83 μA. Surface potentials on photoreceptor 410 between brush 451A and cleaning blade 452A were measured on a non-exposure area and on an exposure area, by changing charging potential to −400V, −600V and −800V.

TABLE 1

| | Surface potential of photoreceptor (non-exposure area) [V] | | | Surface potential of photoreceptor (exposure area) [V] | | |
|---|---|---|---|---|---|---|
| Transfer current value [μA] | Charging potential: −400 V | Charging potential: −600 V | Charging potential: −800 V | Charging potential: −400 V | Charging potential: −600 V | Charging potential: −800 V |
| 33 | −280 | −460 | −600 | −110 | −150 | −170 |
| 50 | −150 | −290 | −480 | 0 | −50 | −70 |
| 67 | −30 | −200 | −330 | 90 | 50 | 0 |
| 83 | 100 | −70 | −200 | 200 | 150 | 100 |

TABLE 2

| | Surface potential of photoreceptor (non-exposure area) [V] | | | Surface potential of photoreceptor (exposure area) [V] | | |
|---|---|---|---|---|---|---|
| Transfer current value [μA] | Charging potential: −400 V | Charging potential: −600 V | Charging potential: −800 V | Charging potential: −400 V | Charging potential: −600 V | Charging potential: −800 V |
| 33 | −480 | −660 | −800 | −310 | −350 | −370 |
| 50 | −350 | −490 | −680 | −200 | −250 | −270 |
| 67 | −230 | −400 | −530 | −110 | −150 | −200 |
| 83 | −100 | −270 | −400 | 0 | −50 | −100 |

TABLE 3

| | Surface potential of photoreceptor (non-exposure area) [V] | | | Surface potential of photoreceptor (exposure area) [V] | | |
|---|---|---|---|---|---|---|
| Transfer current value [μA] | Charging potential: −400 V | Charging potential: −600 V | Charging potential: −800 V | Charging potential: −400 V | Charging potential: −600 V | Charging potential: −800 V |
| 33 | −350 | −510 | −650 | −160 | −200 | −220 |
| 50 | −220 | −340 | −530 | −50 | −100 | −120 |
| 67 | −100 | −250 | −380 | 40 | 0 | −50 |
| 83 | 50 | −120 | −250 | 150 | 100 | 50 |

Table 1 shows results of using conductive acrylic fiber SA-7 made by TORAY INDUSTRIES, INC. as a bristle in brush 451A, Table 2 shows results of using GBN fiber SA-7 made by KB SEIREN, LTD. as a bristle in brush 451A, and Table 3 shows results of using UUN fiber made by UNITIKA LTD. as a bristle in brush 451A.

In respective surface potentials thus measured, image defects caused by stuck matters α formed on photoreceptor 410 were evaluated in the following classification of five levels. This evaluation was one for image defects caused by stuck matters α which were generated after 100,000 prints were completed under various conditions.

Level 5: Worst level and unacceptable

Level 4: Bad level and unacceptable

Level 3: Slightly bad level and unacceptable

Level 2: Slightly bad level requiring careful observation, and acceptable

Level 1: No image defects

FIG. 9 is a graph showing relationship between surface potential of a photoreceptor and results of evaluation.

The horizontal axis shown in FIG. 9 represents surface potential of a photoreceptor and the vertical axis represents an evaluation level.

In FIG. 9, a symbol "▲" shows the result of using conductive and acrylic fiber SA-7 made by TORAY INDUSTRIES, INC., as a bristle in brush 451A (Table 1), a symbol "□" shows the result of using GBN fiber made by KB SEIREN, LTD. as a bristle in brush 451A (Table 2) and a symbol "○" shows the result of using UUN fiber made by UNITIKA LTD. as a bristle in brush 451A (Table 3).

In the evaluation of image defects caused by stuck matter α formed on photoreceptor 410, Level 1 and Level 2 show an excellent level. With respect to surface potential on photoreceptor 410 between brush 451A and cleaning blade 452A, the results of the aforesaid experiments indicated that an appropriate range (standard potential) that does not generate stuck matter α even when printing for a long time is a range of 0 to −600V. The value of −600V is almost the same as that of charging potential.

Based on this result, the correlation between a transfer current value on primary transfer roller 510 and surface potential on a photoreceptor was made to be a data table shown with Table 4. "A" shows an excellent level, "B" shows a slightly bad level and "C" shows a bad level.

TABLE 4

| Transfer current value [μA] | Surface potential of photoreceptor (non-exposure area) [V] | | | Surface potential of photoreceptor (exposure area) [V] | | |
|---|---|---|---|---|---|---|
| | Charging potential: −400 V | Charging potential: −600 V | Charging potential: −800 V | Charging potential: −400 V | Charging potential: −600 V | Charging potential: −800 V |
| 20 | A | C | C | A | A | A |
| 30 | A | B | C | A | A | A |
| 40 | A | A | B | A | A | A |
| 50 | A | A | A | B | A | A |
| 60 | A | A | A | C | B | A |
| 70 | B | A | A | C | C | B |

For example, when a transfer current value of primary transfer roller 510 is 50 μA and charging potential is −400V, evaluation of non-exposure area between brush 451A and cleaning blade 452A is "A", but, evaluation of exposure area is "B". Therefore, if printing is continued for a long time under this condition, stuck matters α are generated sooner or later, resulting in image defects.

Following two methods are considered under the consideration of the aforesaid results of the experiments and of the evaluation, for realizing that stuck matters α are not generated on photoreceptor 410 even when printing for a long time.

One of them is a method to measure surface potential on photoreceptor 410 between brush 451A and cleaning blade 452A with a sensor, and thereby to adjust surface potential on photoreceptor 410 between brush 451A and cleaning blade 452A. The other method is one to adjust surface potential on photoreceptor 410 between brush 451A and cleaning blade 452A, based on the data table shown in FIG. 4.

First, referring to FIG. 10, there will be explained the method to measure surface potential on photoreceptor 410 between brush 451A and cleaning blade 452A with a sensor, and thereby to adjust surface potential on photoreceptor 410 between brush 451A and cleaning blade 452A.

FIG. 10 is a flow chart relating to operations to control surface potential on a photoreceptor, based on results of measurements for surface potential between a brush and a cleaning blade.

First, charging potential on photoreceptor 410 is determined through stabilizing control before starting printing operations in image forming apparatus 1 (step S1). The stabilizing control is one to measure surface potential with charging potential measuring sensor 421 and thereby to control charging potential so that it may be standard density.

After the charging potential is determined in step S1, ordinary printing operations are carried out (step S2), then, after 1000 prints are made (step S3; Yes), surface potential on photoreceptor 410 between brush 451A and cleaning blade 452A is measured by a surface potential measuring sensor (steps S4 and S5).

The surface potential measuring sensor 422, as shown in FIG. 3(*b*), is arranged between brush 451A and the cleaning blade 452A, and is controlled by CPU 101 in the same way as in charging potential measuring sensor 421. Incidentally, for the reason of a space, it is also possible to provide the surface potential measuring sensor 422 at the downstream side of the cleaning blade 452A, and to regard the aforesaid correlation value from the results of measurements made by the surface potential measuring sensor as surface potential on photoreceptor 410 between brush 451A and cleaning blade 452A.

In step S4, surface potential on a non-exposure area of photoreceptor 410 is measured by a surface potential measuring sensor 422, and results of the measurements are stored in RAM 103.

Next, in step S5, a toner image with a prescribed pattern is formed on a prescribed area (an area to be measured by a surface potential measuring sensor 422) of photoreceptor 410, and surface potential on an exposure area of photoreceptor 410 is measured by a surface potential measuring sensor 422. Results of the measurements are also stored in RAM 103.

Since appropriate surface potential on photoreceptor 410 between brush 451A and cleaning blade 452A is "0 to −600V" as stated earlier, there are judged how the results of measurements conducted in steps S4 and S5 are related to this appropriate surface potential in steps S6, S8 and S10.

First, in step S6, it is judged whether surface potential on non-exposure area measured in step S4 is lower than −600V or not (for example, if the surface potential is −800V, the surface potential on the non-exposure area is lower than −600V, while, if the surface potential is −400V, the surface potential on the non-exposure area is higher than −600V).

When surface potential on a non-exposure area is lower than −600V (step S6; Yes), a transfer current value of primary transfer roller 510 is raised by 10 μA (step S7) for making surface potential on non-exposure area to be in an appropriate range (0 to −600V), or for causing the surface potential on non-exposure area to be closer to the appropriate range (step S7), and surface potential on non-exposure area is adjusted. If the transfer current value of primary transfer roller 510 is changed greatly, transfer conditions are changed greatly, which is not preferable, and if printing is conducted for a long time without changing transfer current value of primary transfer roller 510, stuck matters α are formed on photoreceptor 410, therefore, the transfer current value is raised by 10 μA. Meanwhile, the value of 10 μA is an example, and other values are also acceptable if the purpose is to adjust surface potential on a non-exposure area without changing transfer conditions greatly.

On the other hand, when surface potential on a non-exposure area is higher than −600V (step S6; No, 0V or +100V), surface potential on the non-exposure area is judged whether it is higher than 0V that is an upper limit of an appropriated range or not (step S8).

When surface potential on the non-exposure area is higher than 0V (step S8; Yes), transfer current value of primary transfer roller 510 is lowered by 10 μA (step S9) and surface potential of the non-exposure area is adjusted, for the purpose of causing the surface potential on the non-exposure area to be in the appropriate range (0 to −600V) as far as possible, or to approach the appropriate range. The reason for lowering by 10 μA is to prevent that stuck matters α are formed on photoreceptor 410 without changing transfer conditions greatly, which is the same as contents of explanation in step S7.

On the other hand, when surface potential on the non-exposure area is lower than 0V (step S8; No), surface potential on the exposure area measured in step S5 is examined this time, because surface potential on the non-exposure area is within an appropriate range.

Since the surface potential on the exposure area is never be lower than −600V that is a lower limit of the appropriate range, the surface potential on the exposure area measured in step S5 is judged whether it is lower than 0V that is an upper limit of the appropriate range or not, in step S10.

When surface potential on the non-exposure area is higher than 0V (step S10; Yes), transfer current value of primary transfer roller 510 is lowered by 10 μA (step S11) and surface potential of the exposure area is adjusted, for the purpose of causing the surface potential on the exposure area to be in the appropriate range (0 to −600V) as far as possible, or to approach the appropriate range. The reason for lowering by 10 μA is to prevent that stuck matters α are formed on photoreceptor 410 without changing transfer conditions greatly, which is the same as contents of explanation in step S7.

On the other hand, when surface potential on the exposure area is lower than 0V (step S8; No), adjustment operations are terminated without changing transfer current values of primary transfer roller 510, because surface potential on the non-exposure area is within an appropriate range.

When surface potential of photoreceptor 410 between brush 451A and cleaning blade 452A is measured by a surface potential measuring sensor 422, and a transfer current value of primary transfer roller 510 based on results of the measurements to adjust surface potential of photoreceptor 410, as explained by using FIG. 10 above, it is possible to prevent that stuck matters α are formed on photoreceptor 410 even when printing for a long time.

Next, referring to FIG. 11, there will explained a method to adjust surface potential of photoreceptor 410 between brush 451A and cleaning blade 452A based on a data table shown with Table 4.

FIG. 11 is a flow chart relating to operations to control surface potential of a photoreceptor based on a data table.

First, surface potential of a photoreceptor is determined by stabilizing control prior to starting printing operations in image forming apparatus 1 (step S21). Stabilizing control is to measure surface potential with a charging potential measuring sensor 421 and thereby to control charging potential so that density as a standard may be obtained.

After the charging potential is determined in step S1, ordinary printing operations are carried out (step S22), then, after 1000 prints are made (step S23; Yes), continuation of printing operations as they are is judged whether it falls on the condition to generate stuck matters α on photoreceptor 410 or not (step S24).

Judgment in step S24 is made from a transfer current value in primary transfer roller 510 and from a value of charging potential of photoreceptor 410 (a value measured and obtained by charging potential measuring sensor 421 after step S23), based on the data table shown in Table 4 stored in ROM 102. In other words, data table shown in Table 4 is compared with a transfer current value and a value of charging potential. For example, if a transfer current value of primary transfer roller is 30 μA, and charging potential is −400V, the condition is judged not to correspond to the condition of occurrence of stuck matters α, because both non-exposure area and exposure area represent an area of "A". On the other hand, if a transfer current value of primary transfer roller is 30 μA, and charging potential is −600V, the condition is judged to correspond to the condition of occurrence of stuck matters α, because non-exposure area represents an area of "B".

If a condition is judged to correspond to one for occurrence of stuck matters α in step S24 (step S24; Yes), the condition is judged whether it corresponds to one for occurrence of stuck matters α on a non-exposure area of photoreceptor 410 or not (step S25).

Then, if a judgment is formed to correspond to the condition for occurrence of stuck matters α in a non-exposure area of photoreceptor 410 (step S25; Yes), a transfer current value of primary transfer roller 510 is judged whether it is 70 μA or not (step S26), and if the transfer current value of primary transfer roller 510 is judged to be 70 μA (step S26; Yes), transfer current value is lowered by 10 μA (step S27), an evaluation of non-exposure area is changed to the area of "A" in a data table in Table 4. By correcting a transfer current value of primary transfer roller 510 based on a data table of Table 4 as stated above, it is possible to make surface potential of photoreceptor 410 between brush 451A and cleaning blade 452A to be an appropriate surface potential, and thereby, to conduct excellent image forming.

On the other hand, if a transfer current value of primary transfer roller 510 is judged not to be 70 μA in step S26 (step S26; No), a judgment is made whether raising of transfer current value of primary transfer roller 510 by 10 μA creates a condition for no occurrence of stuck matters α or not (step S28), because the transfer current value of primary transfer roller S10 can be judged to be 20 to 40 μA for occurrence of stuck matters α on the non-exposure area as shown with Table 4 of primary transfer roller 510.

If raising of transfer current value of primary transfer roller 510 by 10 μA creates a condition for no occurrence of stuck matters α (step S28; Yes), surface potential of photoreceptor 410 between brush 451A and cleaning blade 452A is made to be appropriate surface potential, by raising a transfer current value of primary transfer roller 510 by 10 μA (step S29).

If raising of transfer current value of primary transfer roller 510 by 10 μA still creates a condition for occurrence of stuck matters α (step S28; No), toner concentration in a developing unit is raised by 0.5% (step S30), and then, stabilizing control is carried out to determine charging potential (step S31). These operations are under judgment that, if toner concentration is changed and stabilizing control is carried out, an area having different charging potential may be created, and appropriate surface potential causing no occurrence of stuck matters α may be obtained.

Returning to step S25, if judgment is formed that stuck matters α are not generated on a non-exposure area, namely, that a situation corresponds to the condition that stuck matters α are generated on an exposure area (step S25; No), the condition is judged whether it turns out to be one for no occurrence of stuck matters α or not, if a transfer current value of primary transfer roller 510 is lowered by 10 μA (step S32).

If lowering of transfer current value of primary transfer roller 510 by 10 μA creates a condition for no occurrence of stuck matters α (step S32; Yes), surface potential of photoreceptor 410 between brush 451A and cleaning blade 452A is made to be appropriate surface potential, by lowering a transfer current value of primary transfer roller 510 by 10 μA.

If lowering of transfer current value of primary transfer roller 510 by 10 μA still creates a condition for occurrence of stuck matters α (step S32; No), toner concentration in a developing unit is raised by 0.5% (step S34), and then, stabilizing control is carried out to determine charging potential (step S35). These operations are under judgment that, if toner concentration is changed and stabilizing control is carried out, an area having different charging potential may be created, and appropriate surface potential causing no occurrence of stuck matters α may be obtained.

As explained above, referring to FIG. 11, when a transfer current value of prima 452A is adjusted, it is possible to prevent that stuck matters α are generated on photoreceptor 410, even when printing for a long time.

Incidentally, the invention is not limited to the present embodiment, and modifications and addition which do not depart from the spirit and scope of the invention can be included in the invention.

Data table shown in Table 4 is an example, and other data tables are acceptable provided that a relationship between a transfer current value of primary transfer roller 510 and charging potential is appropriate.

Further, although operations in FIGS. 10 and 11 are carried out after printing for 1000 prints is terminated, these operations may also be carried out when images have a prescribed image area rate, or carried out by instructions of a user through operation and display unit 105.

In the embodiment of the image forming apparatus, it is possible to prevent adhesion of toner or the like on an image carrier, and to form an excellent image.

What is claimed is:

1. An image forming apparatus comprising:

(a) an image carrier;

(b) a charging unit which charges a surface of the image carrier;

(c) a brush which removes toner remaining on the image carrier by rubbing the surface of the image carrier;

(d) a cleaning blade provided downstream of the brush in a rotational direction of the image carrier, which removes the toner remaining on the image carrier;

(e) a surface potential measuring sensor which measures a surface potential of the image carrier between the brush and the cleaning blade; and (f) a controller which causes the surface potential measuring sensor to conduct a measuring operation and adjusts the surface potential of the image carrier between the brush and the cleaning blade on the basis of a measurement result.

2. The image forming apparatus of claim 1, further comprising a transfer unit which transfers a toner image formed on the image carrier onto a transfer material, wherein the controller adjusts the surface potential of the image carrier between the brush and the cleaning blade by correcting a transfer current value of the transfer unit.

3. The image forming apparatus of claim 1, wherein the measuring operation represents measuring a surface potential of an exposure area on the image carrier and the surface potential of a non-exposure area on the image carrier.

4. The image forming apparatus of claim 1, wherein the controller adjusts the surface potential of the image carrier between the brush and the cleaning blade when the measurement result does not fall within a predetermined range excluding a potential value whose polarity is reverse to the toner.

5. The image forming apparatus of claim 4, wherein the predetermined range is from 0 V to −600 V.

6. An image forming apparatus comprising:

(a) an image carrier;

(b) a charging unit which charges a surface of the image carrier;

(c) a transfer unit which transfers a toner image formed on the image carrier onto a transfer material;

(d) a brush which removes a toner remaining on the image carrier by rubbing the surface of the image carrier;

(e) a cleaning blade provided downstream of the brush in a rotational direction of the image carrier, which removes the toner remaining on the image carrier;

(f) a charging potential measuring sensor which measures a charging potential on the image carrier charged by the charging unit;

(g) a memory unit which stores a data table in which a relation among the charging potential on the image carrier charged by the charging unit, a transfer current value of the transfer unit, and a stuck matter sticking to the image carrier, is stipulated; and (h) a controller which compares a measurement result by the charging potential measuring sensor with the transfer current value of the transfer unit in the data table, and corrects the transfer current value of the transfer unit or an image density according to a comparison result.

7. The image forming apparatus of claim 6, the data table stipulates an evaluation whether or not the stuck matter is formed on the image carrier with respect to an exposure area and a non-exposure area on the image carrier.

* * * * *